US007381920B1

(12) United States Patent
Lee

(10) Patent No.: US 7,381,920 B1
(45) Date of Patent: Jun. 3, 2008

(54) THIN TOUCH SWITCH

(75) Inventor: Chen-Lung Lee, Taoyuan Hsien (TW)

(73) Assignee: Yoochi Precision Industry Co., Ltd., Taoyuan Hsien (TW)

( * ) Notice: Subject to any disclaimer, the term of this patent is extended or adjusted under 35 U.S.C. 154(b) by 44 days.

(21) Appl. No.: 11/605,423

(22) Filed: Nov. 29, 2006

(51) Int. Cl.
*H01H 13/14* (2006.01)

(52) U.S. Cl. ..... 200/341; 200/520; 200/329

(58) Field of Classification Search ..... 200/341–345, 200/329, 333, 302.2, 520, 406
See application file for complete search history.

(56) References Cited

U.S. PATENT DOCUMENTS 4,814,566 A * 3/1989 Sigl ..... 200/305
6,621,446 B1 * 9/2003 Chaillie ..... 341/176
6,946,610 B2 * 9/2005 Takeuchi et al. ..... 200/406
6,982,392 B1 * 1/2006 Burger ..... 200/302.1
2001/0022269 A1 * 9/2001 Watanabe et al. ..... 200/406

* cited by examiner

*Primary Examiner*—K. Richard Lee
(74) *Attorney, Agent, or Firm*—Rosenberg, Klein & Lee

(57) ABSTRACT

The present invention relates to an improved thin touch switch that includes a penetrating hole disposed on a plastic body and proximate to an exposed end of a metal component of a terminal and a high heat resisting and waterproof plastic material filled and sealed at the penetrating hole, such that when pins of the metal components of the touch switch are soldered to a printed circuit board, the plastic material used for sealing and combining the metal components and the plastic body can totally block the cleaning solution from entering from the joint that connects the metal components and the plastic body during the soldering process and can prevent possible short circuits to the metal components of the terminal, so as to effectively improve the life expectancy and safety of the touch switch.

2 Claims, 4 Drawing Sheets

THIN TOUCH SWITCH

BACKGROUND OF THE INVENTION

1. Field of the Invention

The present invention relates to an improved thin touch switch, and more particularly to a touch switch having a penetrating hole corresponding to a metal component and disposed on a plastic body proximate to an exposed end of a terminal of the metal component, and the penetrating hole is filled and sealed with a high-temperature heat resisting and waterproof plastic material, such that a cleaning solution can be blocked from passing through the joint that connects pins of the metal component and the plastic body of the touch switch during a circuit board soldering process, so as to achieve the effects of producing a safer touch switch and extending the life expectancy of the touch switch.

2. Description of the Related Art

As science and technology advances, the size of various electronic components of an electronic product becomes increasingly smaller and thinner to facilitate the carrying and use of the electronic product. For example, the thickness of a touch switch falls below 4 mm to provide a super thin touch switch which is generally used for thin portable mobile communication products.

Referring to FIGS. 1 and 2 for the structure and operation of the foregoing thin touch switch, the thin touch switch includes a terminal 10 in a predetermined shape (including two metal components 101, 102 for an electric conduction) packaged in a plastic body 20, such that pins 1011, 1021 disposed on both ends of each metal component 101, 102 are exposed and soldered with a printed circuit board. The terminal 10 and the plastic body 20 are combined by plastic injection molding to facilitate the mass production of the thin touch switch. However, the thicker the touch switch, the thicker is the plastic body 20 and the more is the plastic material used for the injection molding. The plastic material used for the injection molding can combine and package the terminals 10 more densely and evenly. On the other hand, the thinner the touch switch, the lesser is the plastic material used for the injection molding. As a result, an insufficient packaging or even a crevice may occur between the plastic body 20 and the terminal 10 during a fast mass production.

After the touch switch including the terminal 10 and the plastic body 20 are produced and molded, the pins 1011, 1021 at an exposed end of the metal component 101, 102 of the terminal 10 are soldered to a printed circuit board (not shown in the figure), such that other electric components can be used by the electronic product. Before the printed circuit board is soldered and installed with different electric components, it is quite common to clean the printed circuit board with a cleaning solution (such as water), and the cleaning solution may remain on the printed circuit board after the soldering process. The remained cleaning solution may cause a short circuit or damage unsealed electric components, and it is not easy for manufacturers to discover such damage, and thus the conventional touch switch requires further improvements. For example, the plastic body 20 of a thin touch switch does not use too much plastic material, and thus crevices may occur during the process of packaging the terminal. Particularly, when the pins 1011, 1021 at both ends of the metal component 101, 102 of the terminal are soldered, the high-temperature heat of the soldering may crack the joint that connects the metal components 101, 102 and the plastic body 20, and the cleaning solution of the circuit board may enter into the touch switch easily or short the circuit of the metal components 101, 102.

In view of the foregoing shortcomings of the prior art, the inventor of the present invention based on years of experience in the related industry to conduct extensive researches and experience, and finally developed an improved thin touch switch in accordance with the present invention.

SUMMARY OF THE INVENTION

The primary objective of the present invention is to overcome the shortcomings of the prior art by providing an improved thin touch switch 1 that comprises a penetrating hole corresponding to a metal component and disposed on a plastic body and proximate to an exposed end of the metal component of a terminal, and a high heat resisting and waterproof plastic material filled and sealed at the penetrating hole, such that when the pins at both ends of the metal component are soldered to a printed circuit board, the plastic material used for sealing and combining the metal components and the plastic body can completely block the cleaning solution remained at the printed circuit board from entering into the touch switch, and prevent possible short circuits to the metal components, so as to effectively improve the life expectancy and safety of the touch switch and the electronic product.

To make it easier for our examiner to understand the objectives, characteristics and effects of the present invention, a preferred embodiment with accompanying drawings are used for a detailed description of the invention as follows.

DETAILED DESCRIPTION OF THE PREFERRED EMBODIMENTS

Figure 1:
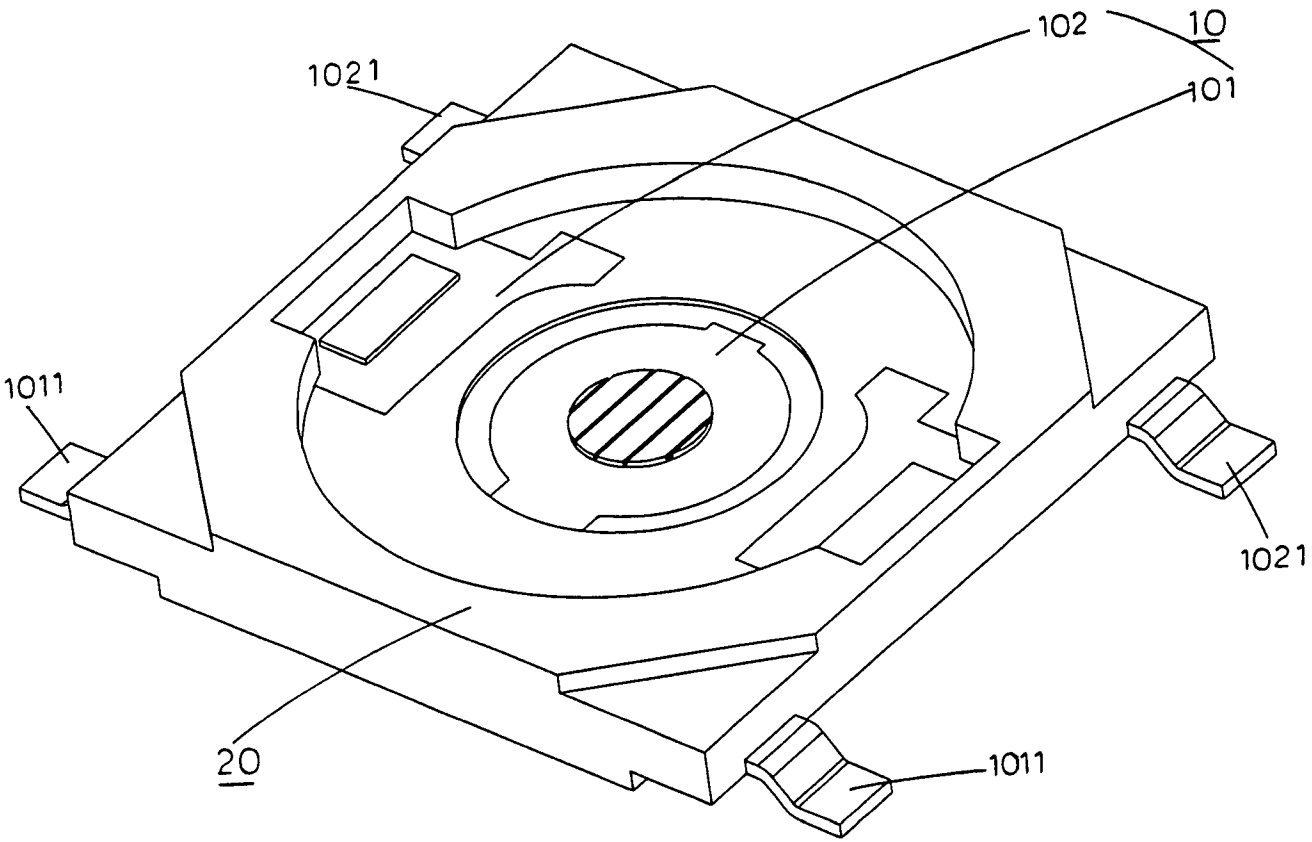
FIG.1 PRIOR ART
FIG. 1 is a schematic view of a conventional thin touch switch.
Figure 2:
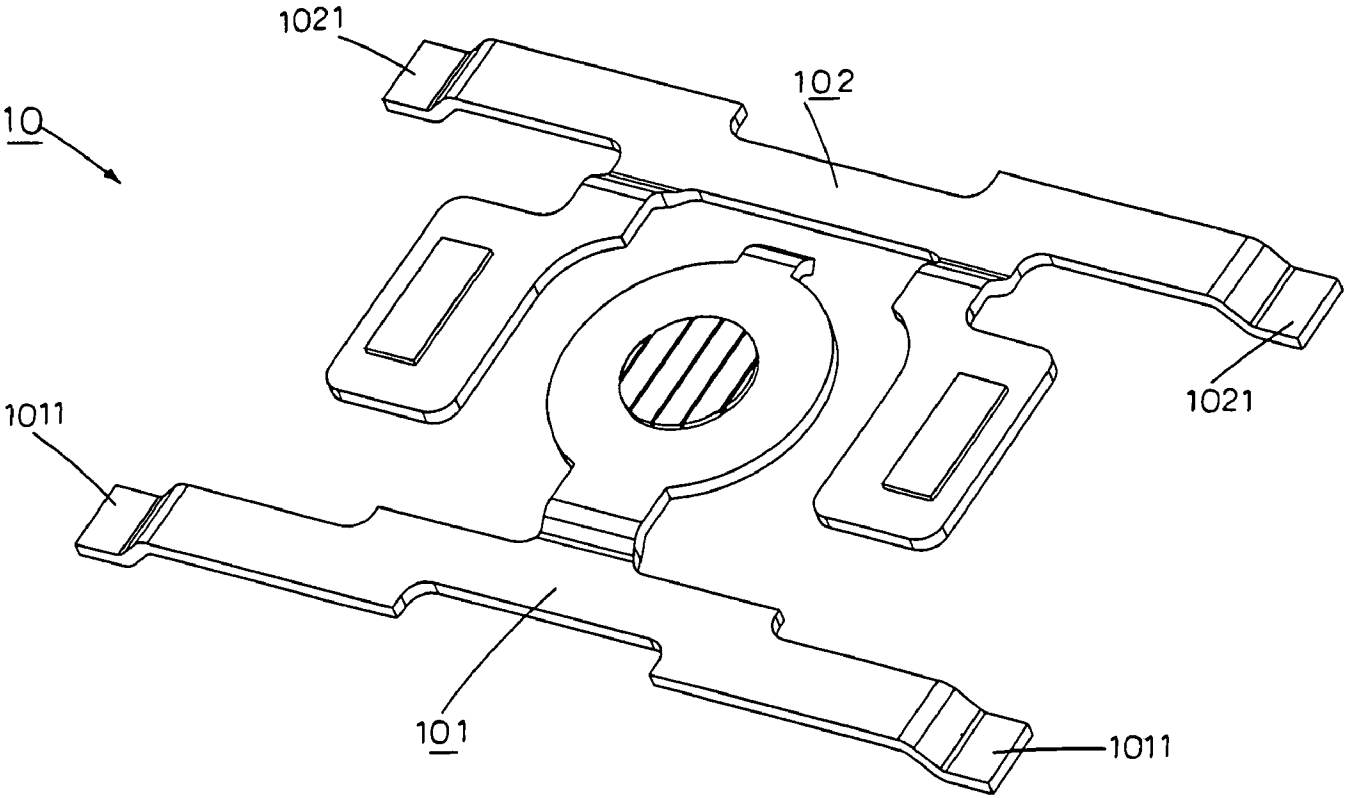
FIG.2 PRIOR ART
FIG. 2 is a schematic view of a conventional terminal.
Figure 3:
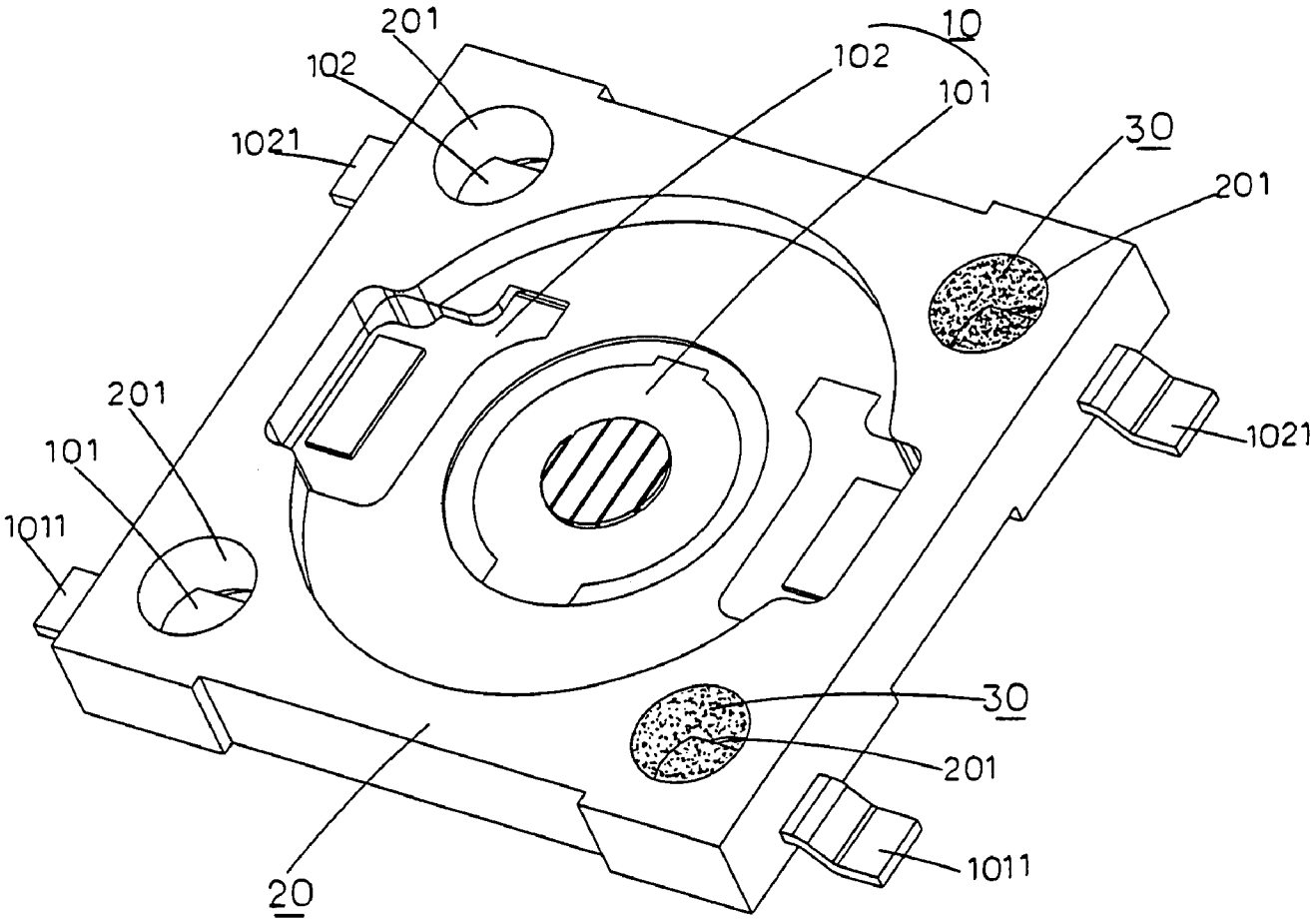
FIG. 3 is a schematic view of the present invention.
Figure 4:
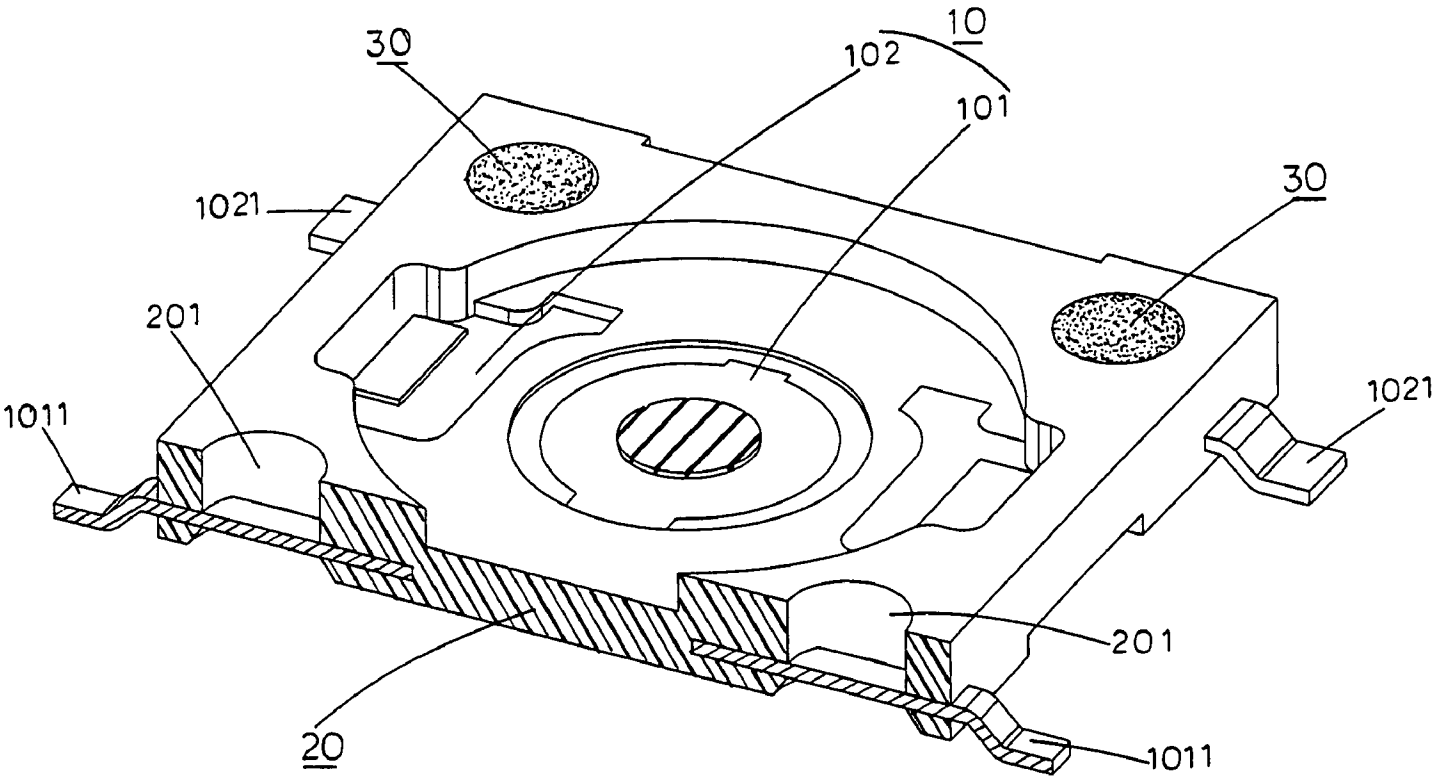
FIG. 4 is cross-sectional view of the present invention.

Referring to FIGS. 3 and 4 for an improve thin touch switch of the present invention, the metal components 101, 102 of the terminal 10 are packaged into the plastic body 20 by plastic injection molding, and then a high-temperature heat resisting and waterproof plastic material 30 (such as a high-temperature resisting proxy resin) is filled and sealed into the penetrating hole 201 corresponding to the installed metal components 101, 102 at the position of the plastic body 20 proximate to the pins 1011, 1021 at both ends of the metal component 101, 102.

The penetrating hole 201 of the plastic body 20 is wider than the corresponding metal component 101, 102, such that after the plastic material 30 is filled into the penetrating hole 201, the corresponding metal component 101, 102 will be sealed and packaged completely.

In the foregoing assembly of the present invention, the high-temperature heat resisting plastic material 30 is used for filling and sealing the penetrating hole 201 of the plastic body 20, so that the corresponding metal components 101, 102 of the terminal can be sealed and packaged completely. When the thin touch switch is installed onto the printed circuit board by a soldering process, the pins 1011, 1021 of the metal component 101, 102 of the terminal 10 are exposed from the plastic body 20, so that the high-temperature heat of the soldering process will not crack the joint that connects the plastic body 20 and the terminal metal component 101, 102, and the cleaning solution remained on the circuit board will flow along the pins 1011, 1021 of the metal component and enter from the crevice. However, the cleaning solution can enter to the position of the sealed plastic material 30, but the cleaning solution will be blocked by the sealed plastic material 30. The cleaning solution cannot flow along the metal components 101, 102 of the terminal 10 further into the plastic body 20. Therefore, the metal components 101, 102 will not have a short circuit due to the electric conduction of the cleaning solution, so as to substantially improve the use of thin touch switch and electronic product.

In summation of the description above, an improved thin touch switch of the present invention herein enhances the performance over the conventional structure, and definitely can overcome the shortcomings of the prior art and comply with the requirements of patent application, and is thus duly filed for patent application.

What is claimed is:

1. An improved thin touch switch, comprising a plastic body and a terminal, and said terminal includes two metal components provided for an electric conduction, and said two metal components are packaged in said plastic body, such that pins at both ends of said plastic body are exposed, characterized in that said plastic body has a penetrating hole disposed at the position of an exposed end proximate to said each metal component of said terminal and corresponding to said metal component, and a high heat-resisting and waterproof plastic material filled and sealed at said each penetrating hole.

2. The improved thin touch switch of claim 1, wherein said penetrating hole of said plastic body is wider than said corresponding metal component of said terminal.

* * * * *